US010941997B2

(12) United States Patent
Trimble

(10) Patent No.: US 10,941,997 B2
(45) Date of Patent: Mar. 9, 2021

(54) CORNER SHOT FIREARM

(71) Applicant: James R. Trimble, Eureka, CA (US)

(72) Inventor: James R. Trimble, Eureka, CA (US)

( * ) Notice: Subject to any disclaimer, the term of this patent is extended or adjusted under 35 U.S.C. 154(b) by 50 days.

(21) Appl. No.: 16/533,138

(22) Filed: Aug. 6, 2019

(65) Prior Publication Data

US 2020/0041223 A1 Feb. 6, 2020

Related U.S. Application Data

(60) Provisional application No. 62/714,989, filed on Aug. 6, 2018.

(51) Int. Cl.

| | |
|---|---|
| ***F41A 19/18*** | (2006.01) |
| ***F41G 3/16*** | (2006.01) |
| ***F41C 27/00*** | (2006.01) |
| ***F41A 19/08*** | (2006.01) |
| ***F41A 19/09*** | (2006.01) |

(52) U.S. Cl.

CPC ..... *F41A 19/183* (2013.01); *F41A 19/08* (2013.01); *F41A 19/09* (2013.01); *F41C 27/00* (2013.01); *F41G 3/165* (2013.01)

(58) Field of Classification Search

CPC ..... F41A 19/08; F41A 19/09; F41A 19/183; F41C 23/12; F41C 27/00; F41G 3/165

See application file for complete search history.

(56) References Cited

U.S. PATENT DOCUMENTS

| | | | | |
|---|---|---|---|---|
| 1,278,027 | A * | 9/1918 | Saunders | F41C 23/12 42/106 |
| 6,543,173 | B1 * | 4/2003 | Golan | F41A 19/09 42/75.04 |
| 7,322,142 | B1 * | 1/2008 | Leung | F41C 23/04 42/71.01 |
| 7,437,847 | B1 * | 10/2008 | Mabry | F41C 23/04 42/71.02 |
| 7,552,557 | B1 * | 6/2009 | Mabry | F41A 11/04 42/71.01 |
| 8,371,056 | B1 * | 2/2013 | Baker | F41C 23/12 42/90 |
| 8,739,452 | B1 * | 6/2014 | Calvert | F41A 11/02 42/90 |
| 8,763,295 | B2 * | 7/2014 | Trimble | F41C 23/12 42/72 |
| 2019/0159178 | A1 * | 5/2019 | Tang | H04L 5/0007 |
| 2020/0141677 | A1 * | 5/2020 | Deaza | F41J 5/10 |

FOREIGN PATENT DOCUMENTS

| | | | | |
|---|---|---|---|---|
| KR | 101013040 B1 * | 2/2011 | | F41A 19/59 |
| WO | WO-2004015355 A2 * | 2/2004 | | F41C 23/04 |
| WO | WO-2019159177 A1 * | 8/2019 | | F41A 11/06 |

* cited by examiner

*Primary Examiner* — Gabriel J. Klein

(57) ABSTRACT

A corner shot firearm comprises one or more clamp, a trigger actuator, a front grip, an accessory trigger, a pivot stud and an aim control wheel. The clamp includes a first mounting point disposed at a front end of the clamp, wherein the first mounting point is configured to mount a secondary firearm. Additionally, the trigger actuator is connected to the first mounting point. The front grip is attached to a rear end of the clamp. The accessory trigger is connected to the front grip such that the accessory trigger is actuatable by a finger of the human hand holding the front grip. Additionally, the pivot stud is connected to the first mounting point. Further, the aim control wheel is connected to the first mounting point.

20 Claims, 10 Drawing Sheets

CORNER SHOT FIREARM

The current application claims a priority to the U.S. Provisional Patent application Ser. No. 62/714,989 filed on Aug. 6, 2018.

FIELD OF THE INVENTION

The present invention generally relates to firearms. More specifically, the present invention relates to a corner shot firearm.

BACKGROUND OF THE INVENTION

An individual's ability to aim or fire at two simultaneous targets in different locations has not currently been adequately addressed. With individuals in battle scenarios a firearm with the ability to shoot around a corner without exposing the individual will be beneficial to the individual using the firearm.

Therefore, there is a need for an improved firearm that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed is a corner shot firearm. The corner shot firearm comprises a clamp comprising a first mounting point disposed at a front end of the clamp, wherein the first mounting point is configured to mount a secondary firearm. Further, the corner shot firearm comprises a trigger actuator connected to the first mounting point, wherein the trigger actuator is configured to actuate a secondary trigger of the secondary firearm mounted to the first mounting point. Further, the corner shot firearm comprises a front grip attached to a rear end of the clamp, wherein the front grip is configured to be held by a human hand. Further, the corner shot firearm comprises an accessory trigger connected to the front grip such that the accessory trigger is actuatable by a finger of the human hand holding the front grip, wherein the accessory trigger is coupled to the trigger actuator such than an actuation of the accessory trigger causes the trigger actuator to actuate the secondary trigger. Further, the corner shot firearm comprises a pivot stud connected to the first mounting point, wherein the pivot stud is configured to allow the first mounting point to be pivotally rotated in relation to the rear end of the clamp. Further, the corner shot firearm comprises an aim control wheel connected to the first mounting point, wherein the aim control wheel is configured to be rotated, wherein a rotation of the aim control wheel causes a corresponding pivotal rotation of the first mounting point.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
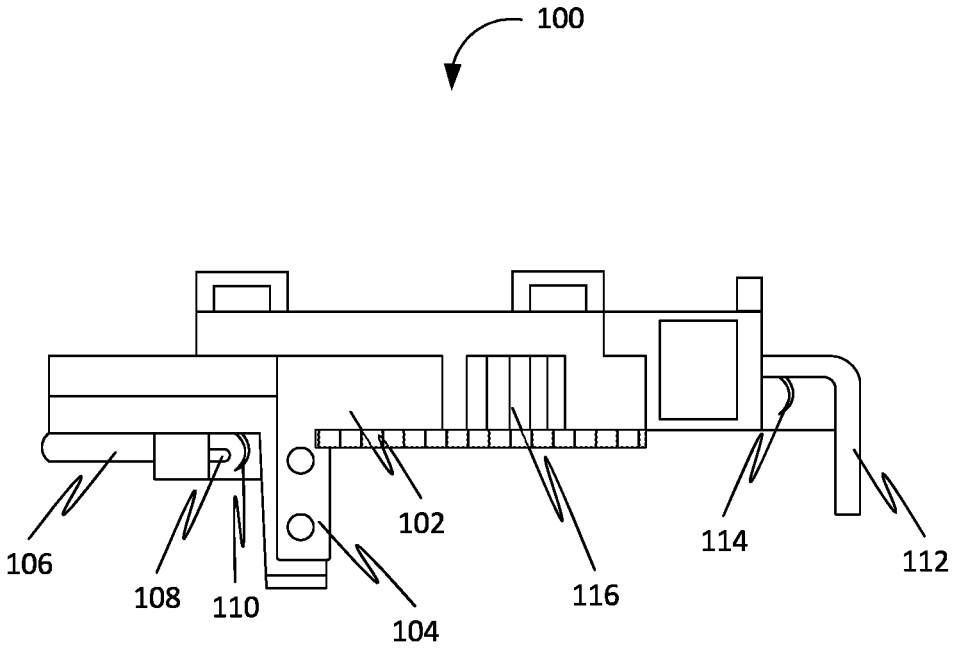
FIG. 1 is a right side view of a corner shot firearm according to some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of firearms, embodiments of the present disclosure are not limited to use only in this context.

Overview

According to some embodiments, the present disclosure relates generally to an apparatus for a rifle. Further, the disclosure relates to an apparatus for a firearm, shotgun, or any type gun that has a pivoting pistol or any type barrel mounted underneath the main firearm allowing for an individual to shoot a target around a corner or aim on two separate targets at one time.

According to some embodiments, a corner shot firearm is disclosed. The corner shot firearm may be a useful gun that can be used by soldiers, police, security forces, recreational users, and any other interested user. Further, the firearm may be designed with a plastic/composite/metal/other material shell which can come in a variety of colors, such as camouflage, dark red, purple, etc. Further, the top of the firearm allows for open sight. In an alternative embodiment, a scope may be mounted on the firearm with a light on top of the scope.

Further, the disclosed corner shot firearm may be fully operational and ready to shoot around corners before it is attached to a firearm. Further, the corner shot firearm may be battery operated. The corner shot firearm has a clamp which holds a pistol. Further, this clamp may be connected to a pivot stud which allows a user to pivot the pistol around corners. Further, the corner shot firearm has an LCD display screen which shows images from a pivoting pistol attachment on the firearm. Further, the corner shot firearm has an auto-trigger device which allows the user to fire the weapon with an accessory trigger.

Further, the corner shot firearm has an aim control wheel which allows the user to pivot the attached pistol around corners.

Further, the corner shot firearm has space around the top of the attached pistol which allows the top of the pistol to eject shell casings. Further, the corner shot firearm has a specific distance or part of the brace that fastens to the pistol grip in order to facilitate the attachment of the pistol to the firearm.

Further, the corner shot firearm has a small chain which ride upon gears or any other method such as belt drive which facilitates the pivoting motion of the corner shot firearm.

Further, the corner shot firearm has clamps which attach the corner shot firearm to a hand rail or a barrel of the firearm. The corner shot firearm has the pistol harness which may be moved by the chain driven pivot and controlled by the aim control wheel. This pistol harness may be designed to attach many different kinds of pistols.

Further, the corner shot firearm has an electric wire which connects the pistol sighting camera with the LCD display, this function may also be wireless.

Further, the corner shot firearm has the pistol harness which has an additional brace. The pistol brace and the control wheel serve partly as a hand grip to operate the control wheel.

Further, the corner shot firearm has an LCD target monitor which may be attached to the left side but can be designed to fit the right side above the trigger of the firearm.

Further, the corner shot firearm has the LCD target monitor may be zooming capable and displays remaining rounds left to be fired, also can be set in an open or closed position. The accessory trigger fits over the primary trigger and may be designed to fit perfectly on any firearm.

Further, the corner shot firearm may be easily attached to the hand rail or the barrel of a firearm. Additionally, the LCD target monitor may be easily attached to the left side above the trigger of the firearm. The accessory trigger may be set in front of the primary trigger. This accessory trigger may be in a convenient place for firing and allows for remote firing of the pistol trigger. The pistol brace has a pistol attached to it. A pistol can be attached and removed quickly. Additionally, the pistol brace can be attached with a pistol attached or only the pistol can be removed. The user can rotate a pistol free hand around a corner if the pistol may be unlocked from the control wheel and pistol brace.

Further, the corner shot firearm provides an apparatus for a firearm that has a pivoting pistol apparatus attached underneath a main firearm, so the individual can fire around a corner without exposing their body and at the same time be able to aim at a different target with the same firearm.

Further, with the corner shot firearm, an individual has the ability to cover their front with a primary firearm and fire at various targets and around corners. The corner shot firearm has a pivoting pistol or barrel apparatus attached underneath a primary firearm so the individual can fire around a corner without exposing their body and at the same time be able to aim at a different target with the same firearm.

Referring now to figures, FIG. 1 is a right side view of a corner shot firearm 100 according to some embodiments. Further, the corner shot firearm 100 may include a clamp 102. The clamp 102 may include a first mounting point 104 disposed at a front end of the clamp 102. Further, the first mounting point 104 may be configured to mount a secondary firearm 106.

Further, the corner shot firearm 100 may include a trigger actuator 108 connected to the first mounting point 104. Further, the trigger actuator 108 may be configured to actuate a secondary trigger 110 of the secondary firearm 106 mounted to the first mounting point 104.

According to further embodiments, the trigger actuator 108 may include an electromechanical actuator configured to actuate the secondary trigger based on a control signal received from a controller. Further, the controller may be electrically coupled to the accessory trigger. Further, the controller may be configured to generate the control signal based on actuation of the accessory trigger. Further, the corner shot firearm 100 may further include a power source configured to provide electrical energy to the electromechanical actuator.

Further, the corner shot firearm 100 may include a front grip 112 attached to a rear end of the clamp 102. Further, the front grip 112 may be configured to be held by a human hand.

Further, the corner shot firearm 100 may include an accessory trigger 114 connected to the front grip 112 such that the accessory trigger 114 may be actuatable by a finger of the human hand holding the front grip 112. Further, the accessory trigger 114 may be coupled to the trigger actuator 108 such than an actuation of the accessory trigger 114 causes the trigger actuator 108 to actuate the secondary trigger 110.

Further, the corner shot firearm 100 may include a pivot stud (shown in FIG. 3) connected to the first mounting point 104. Further, the pivot stud may be configured to allow the first mounting point 104 to be pivotally rotated in relation to the rear end of the clamp 102.

Further, the corner shot firearm 100 may include an aim control wheel 116 connected to the first mounting point 104. Further, the aim control wheel 116 may be configured to be rotated, wherein a rotation of the aim control wheel 116 causes a corresponding pivotal rotation of the first mounting point 104. Further, the aim control wheel 116 may be coupled with the pivot stud.

According to some embodiments, the clamp 102 may further include a second mounting point configured to mount a primary firearm. The primary firearm may at least one of a rifle, a shotgun, a long gun, a machine gun, an automatic rifle, an assault rifles. Further, the second mounting point may be configured to mount at least one of a hand-rail and a barrel of the primary firearm. Further, the clamp may include a fourth mounting point configured to mount at least one of a scope configured to provide optical magnification, a light source configured to emit light and a primary camera configured to capture an image, wherein a primary optical axis of the primary camera is parallel to a primary line of fire of the primary firearm mounted to the second mounting point.

According to some embodiments, the first mounting point 104 may include a quick release mechanism configured to facilitate mounting and demounting of the secondary firearm 106 to the first mounting point 104. Further, the quick release mechanism may allow a user to easily and quickly remove an attached device, such as the secondary firearm 106. Further, at least one of an electroshock weapon, or a knife may be mounted at the first mounting point 104.

According to some embodiments, a locking mechanism may be coupled to the first mounting point 104. Further, the locking mechanism may be configured to be set in one of a locked state and an unlocked state. While in the locked state, the locking mechanism may be configured to prevent movement of the first mounting point 104 independent of the rotation of the aim control wheel 116. While in the unlocked state, the locking mechanism may be configured to allow pivotal rotation of the first mounting point 104 by a rotatory force imparted directly to the first mounting point 104.

For example, the locking mechanism may include a pin that prevents the first mounting point 104 (and any attached items, such as the secondary firearm 106) from rotating. This allows a user to steady the secondary firearm 106 and prevent undesired movements. Further, the locking mechanism may be configured to lock the secondary firearm 106 in a forward facing position by default.

Figure 2:
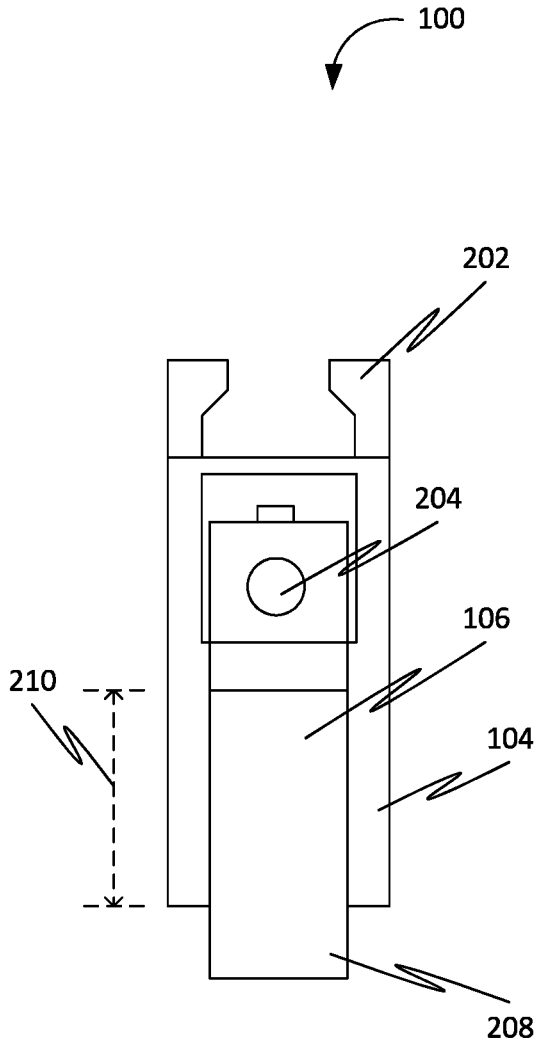
FIG. 2 is a front view of the corner shot firearm according to some embodiments.

FIG. 2 is a front view of the corner shot firearm 100 according to some embodiments. Further, the corner shot firearm 100 may include a view finder 202. Further, the secondary firearm 106 may include a muzzle 204.

Further, the secondary firearm 106 may include a pistol. Further, the first mounting point 104 may include a receptacle (not shown) configured to receive at least a portion of a hand-grip 208 of the pistol, wherein a depth 210 of the receptacle may be based on a length of the hand-grip 208. Further, a dimension of the receptacle corresponds to a dimension of barrel of the secondary firearm 106.

Further, a structure of the first mounting point 104 may provide a space around a top of the secondary firearm 106 mounted to the first mounting point 104 in order to facilitate ejection of shell casings from the secondary firearm 106.

Figure 3:
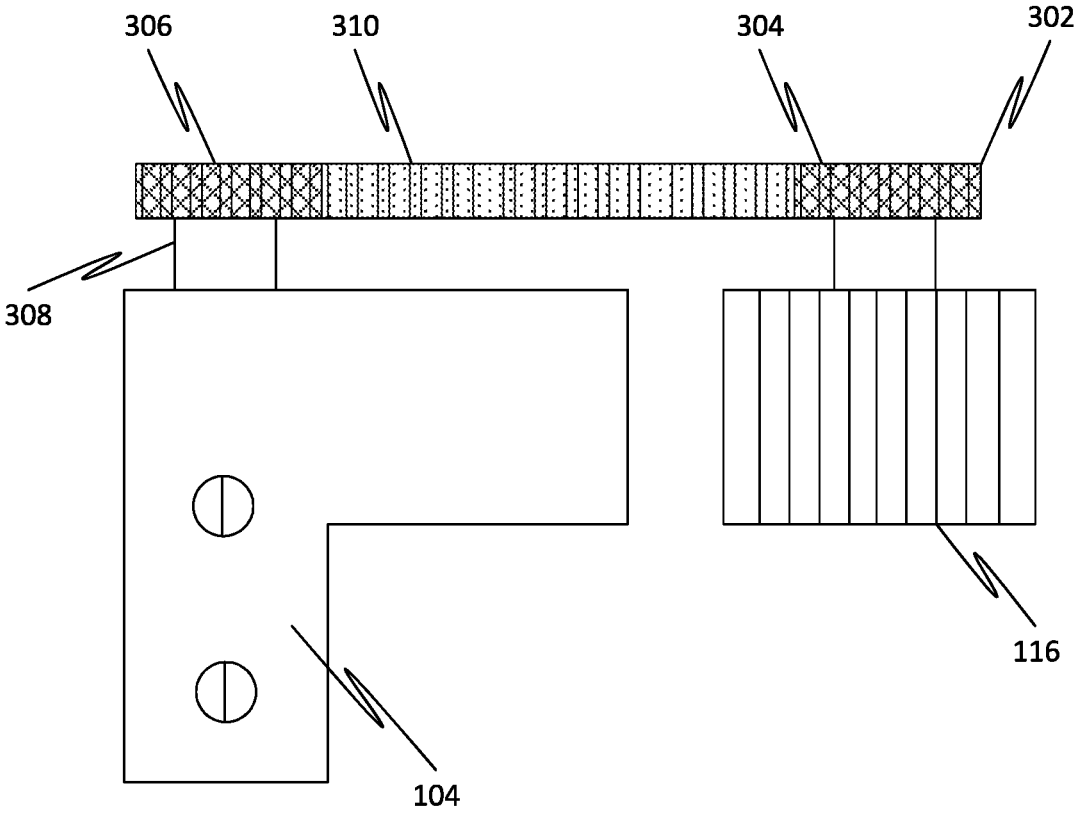
FIG. 3 is a right side view of a transmission of the corner shot firearm according to some embodiments.

FIG. 3 is a right side view of a transmission 302 of the corner shot firearm 100 according to some embodiments. The transmission 302 is installed within the body of the clamp 102. Further, a first end of the transmission 302 may be rotationally coupled to the aim control wheel 116 and a second end of the transmission 302 may be rotationally coupled to the first mounting point 104.

In further embodiments, the transmission may include a power source configured to provide electrical energy. Further, the transmission may include an electric motor rotationally coupled to the second end of the transmission. Further, the electric motor may be electrically coupled to the power source. Yet further, the transmission may include a rotation sensor coupled to the aim control wheel. The rotation sensor may be configured to generate rotation data corresponding to rotation of the aim control wheel. Further, the transmission may include a controller electrically coupled to the electric motor. The controller may be configured to control the electric motor based on the rotation data.

In some embodiments, the transmission 302 may include a plurality of gears 304, 306, 310 forming a gear train. Further, a first gear 304 of the gear train may be rotationally coupled to the aim control wheel 116. Further, a second gear 306 of the gear train may be rotationally coupled to first mounting point 104. The second gear 306 may be rotationally coupled to first mounting point 104 via a pivot stud 308. Yet further, a third gear 310 of the gear train may connect with both the first gear 304 and the second gear 306.

Figure 4:
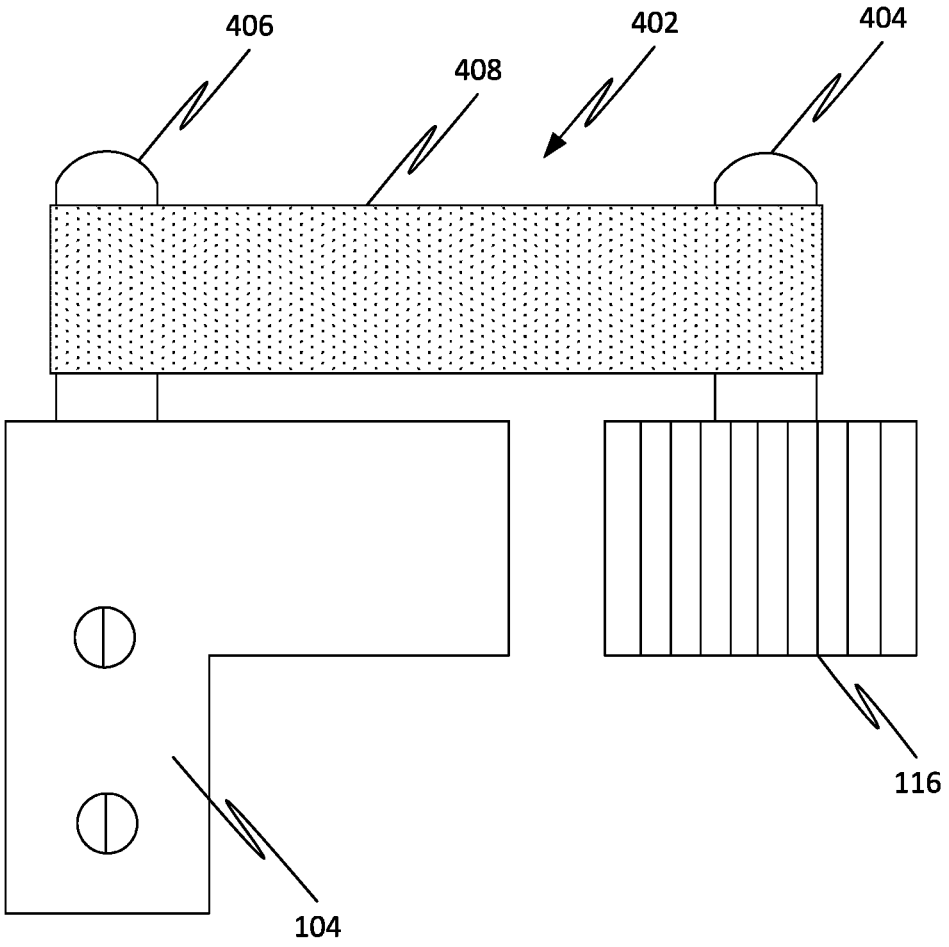
FIG. 4 is a right side view of a transmission of the corner shot firearm according to some embodiments.

FIG. 4 is a right side view of a transmission 402 of the corner shot firearm 100 according to some embodiments. Further, the transmission 402 may include a first pulley 404 rotationally coupled to the aim control wheel 116. Further, the transmission 402 may include a second pulley 406 rotationally coupled to the first mounting point 104. Further, the transmission 402 may include a belt 408 configured to couple the first pulley 404 to second pulley 406.

Figure 5:
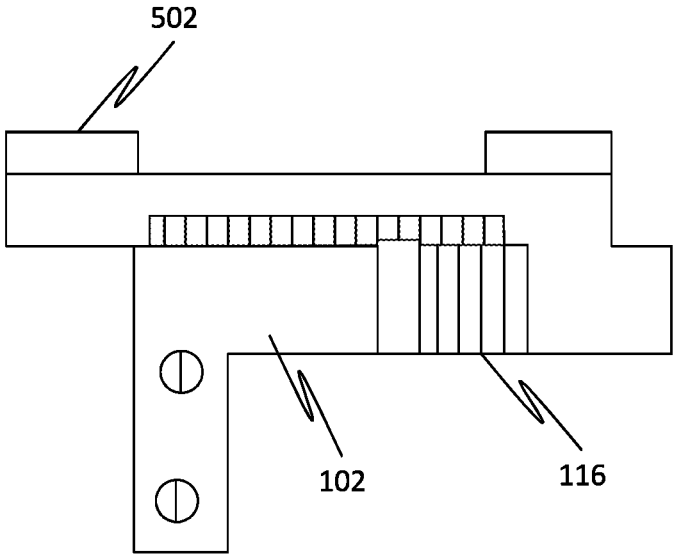
FIG. 5 is a right side view of the clamp of the corner shot firearm according to some embodiments.

FIG. 5 is a right side view of the clamp 102 of the corner shot firearm 100 according to some embodiments. The clamp 102 may include a mounting point 502, which may be used to mount one or more accessories such as a camera, a display, and a view finder.

Figure 6:
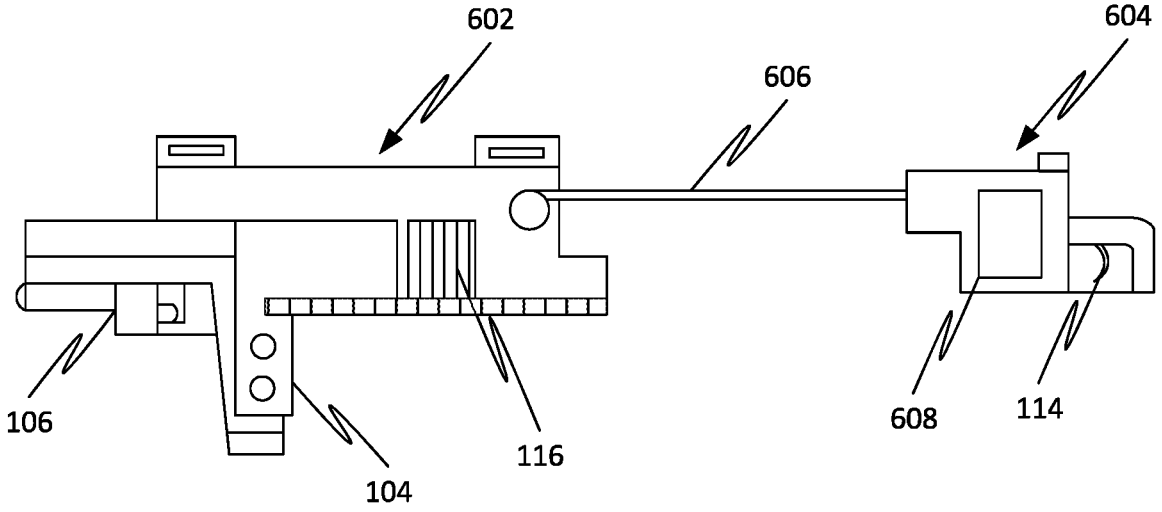
FIG. 6 is a right side view of the corner shot firearm with a front section and a rear section of the corner shot firearm separated, in accordance with some embodiments.

FIG. 6 is a right side view of the corner shot firearm 100 with a front section 602 and a rear section 604 of the corner shot firearm 100 separated, in accordance with some embodiments. An electric wire 606 may connect the clamp 102 to a display device 608, such as an LCD target monitor. The electric wire 606 is secured in the body of the corner shot firearm 100.

Figure 7:
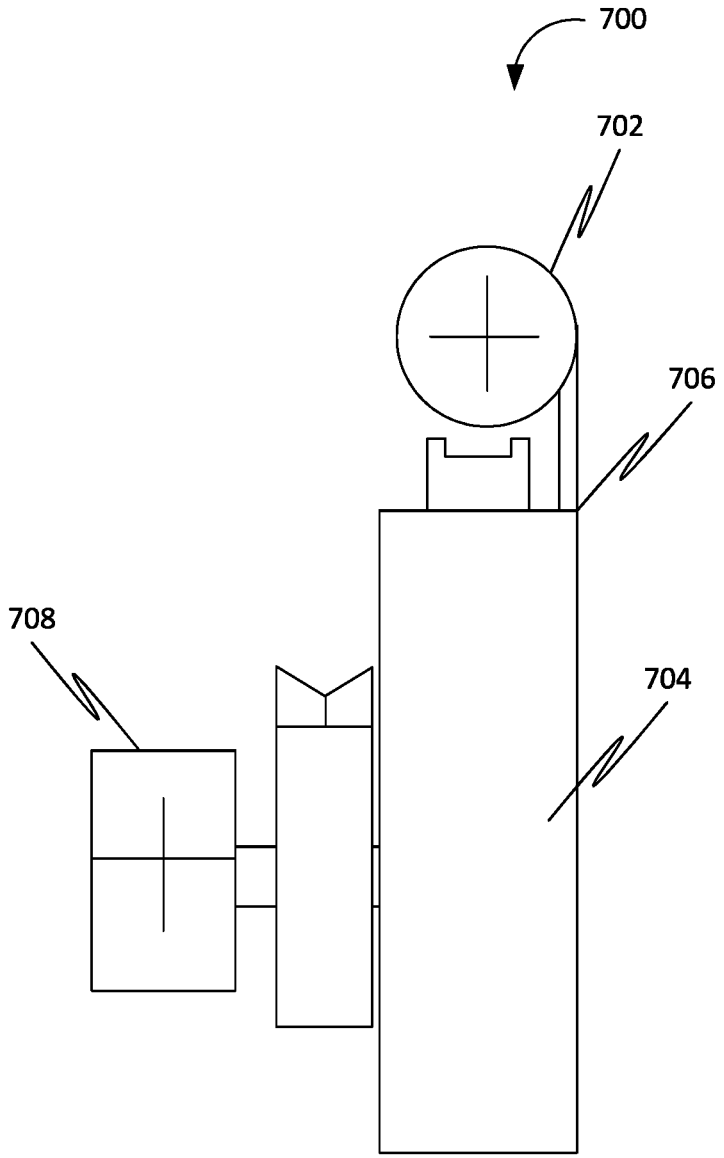
FIG. 7 is a rear view of a corner shot firearm in accordance with some embodiments.

FIG. 7 is a rear view of a corner shot firearm 700 in accordance with some embodiments. Further, the corner shot firearm 700 may include a secondary camera 702 attached to a clamp 704 at a second mounting point 706 on the clamp 704. Further, a secondary optical axis of the secondary camera 702 is parallel to a line of fire corresponding to a secondary firearm mounted at the first mounting point of the clamp 704.

Figure 8:
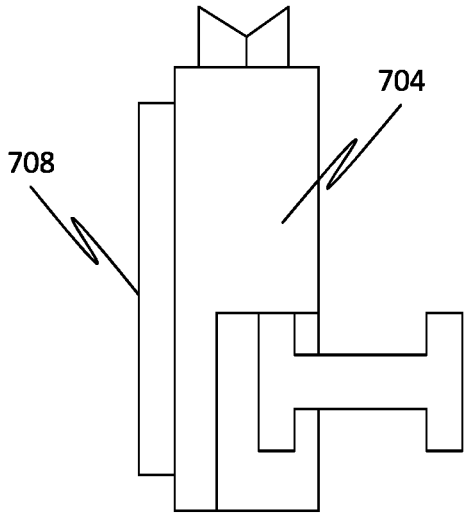
FIG. 8 is a rear view of a corner shot firearm in accordance with some embodiments.

Further, a display device 708 may be attached to the clamp 704 at a third mounting point on the clamp 704. Further, the display device 708 may be communicatively coupled to the secondary camera 702. Further, the display device 708 may be configured to display an image captured by the secondary camera 702. FIG. 7 shows the display device 708 in an open state. FIG. 8 shows the display device 708 in a closed state.

Further, the third mounting point may include a left third mounting point on a first lateral side of the clamp 102 and a right third mounting point on a second lateral side of the clamp 102. Further, the display device 708 may be attachable to each of the left third mounting point and the right.

Further, a power source (not shown) electrically coupled to each of the secondary camera 702 and the display device 708. Further, the power source may be configured to provide electrical energy to each of the secondary camera 702 and the display device 708.

In further embodiments, the corner shot firearm 100 may include an ammunition sensor (not shown) which may be configured to sense a number of ammunition rounds remaining in the secondary firearm 106. Further, the display device 708 may be communicatively coupled to the ammunition sensor, wherein the display device 708 may be further configured to display the number of ammunition rounds remaining.

Figure 9:
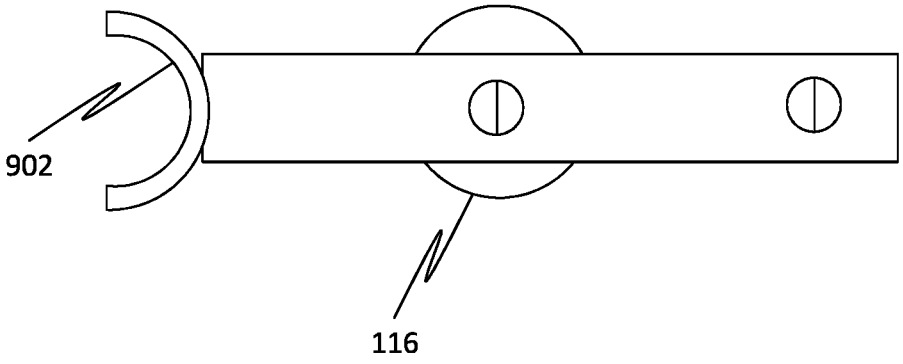
FIG. 9 is a top view of a secondary firearm brace for a secondary firearm in accordance with some embodiments.

FIG. 9 is a top view of a secondary firearm brace 902 for the secondary firearm 106 in accordance with some embodiments. Further, a first end of the secondary firearm brace 902 may be connected to the first mounting point 104 and a second end of the secondary firearm brace 902 may be connectable to a hand-grip of the secondary firearm 106. Further, the secondary firearm brace 902 may be configured to secure the secondary firearm 106 to the first mounting point 104 in spite of a recoil of the secondary firearm 106 upon firing of the secondary firearm 106.

Figure 10:
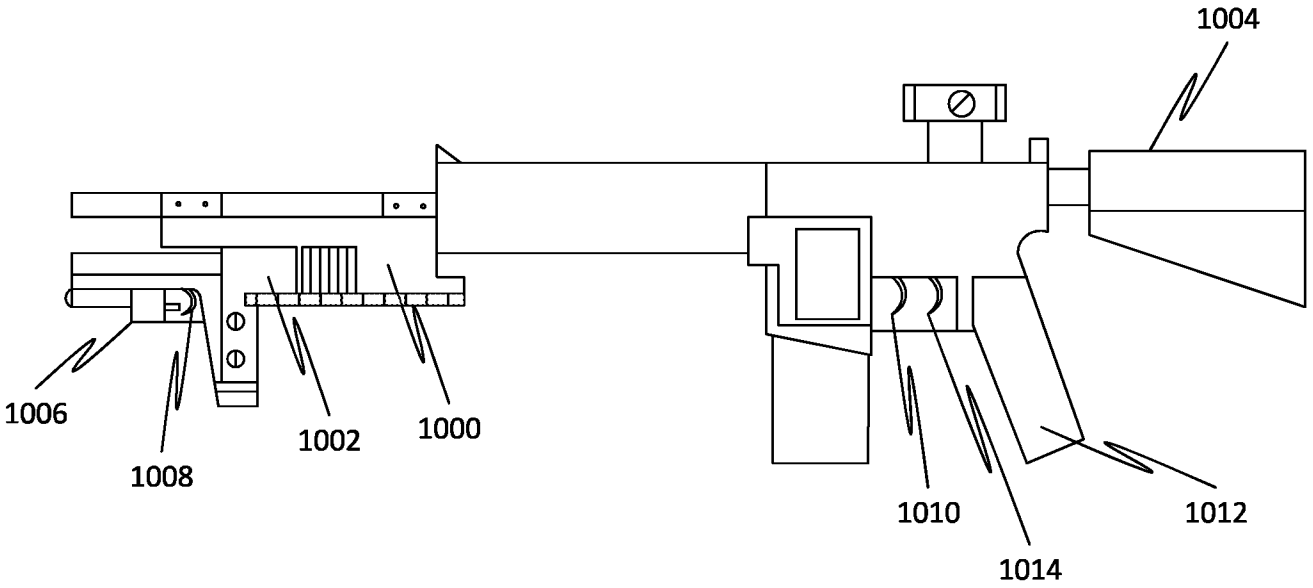
FIG. 10 is a right side view of a clamp of a corner shot firearm with a mounting point configured to mount a primary firearm, in accordance with some embodiments.

FIG. 10 is a right side view of a clamp 1002 of a corner shot firearm 1000 with a mounting point configured to mount a primary firearm 1004, in accordance with some embodiments. Further, the clamp 1002 includes a first mounting point configured to mount a secondary firearm 1006.

Further, the corner shot firearm 1000 includes a trigger actuator connected to the first mounting point, wherein the trigger actuator is configured to actuate a secondary trigger 1008 of the secondary firearm 1006 mounted to the first mounting point.

Further, an accessory trigger 1010 may be connected to a rear grip 1012 such that the accessory trigger 1010 may be actuatable by a finger of the human hand holding the rear grip 1012, wherein the accessory trigger 1010 may be coupled to the trigger actuator such than an actuation of the accessory trigger 1010 causes the trigger actuator to actuate the secondary trigger 1006.

Further, a primary trigger 1014 may be actuatable by a finger of the human hand holding the rear grip 1012. The primary trigger 1014 may be used to operate the primary firearm 1004.

According to some embodiments, at least one of the first mounting point 104, the second mounting point, the third mounting point and the fourth mounting point may include a quick release mechanism configured to facilitate mounting and demounting of the respective components mounted at the at least one of the first mounting point 104, the second mounting point, the third mounting point and the fourth mounting point.

Although the present disclosure has been explained in relation to its preferred embodiment, it is to be understood that many other possible modifications and variations can be made without departing from the spirit and scope of the disclosure.

What is claimed is:

1. A corner shot firearm comprising:

a clamp comprising a first mounting point disposed at a front end of the clamp, wherein the first mounting point is configured to mount a secondary firearm;

a trigger actuator connected to the first mounting point, wherein the trigger actuator is configured to actuate a secondary trigger of a secondary firearm mounted to the first mounting point;

a front grip attached to a rear end of the clamp, wherein the front grip is configured to be held by a human hand;

an accessory trigger connected to the front grip such that the accessory trigger is actuatable by a finger of a human hand holding the front grip, wherein the accessory trigger is coupled to the trigger actuator such than an actuation of the accessory trigger causes the trigger actuator to actuate the secondary trigger;

a pivot stud connected to the first mounting point, wherein the pivot stud is configured to allow the first mounting point to be pivotally rotated in relation to the rear end of the clamp; and an aim control wheel connected to the first mounting point, wherein the aim control wheel is configured to be rotated, wherein a rotation of the aim control wheel causes a corresponding pivotal rotation of the first mounting point.

2. The corner shot firearm of claim 1 further comprising:

a secondary camera attached to the clamp at a second mounting point on the clamp, wherein a secondary optical axis of the secondary camera is parallel to a line of fire corresponding to the secondary firearm mounted to the first mounting point;

a display device attached to the clamp at a third mounting point on the clamp, wherein the display device is communicatively coupled to the secondary camera, wherein the display device is configured to display an image captured by the secondary camera; and a power source electrically coupled to each of the secondary camera and the display device, wherein the power source is configured to provide electrical energy to each of the secondary camera and the display device.

3. The corner shot firearm of claim 2, wherein the third mounting point comprises a left third mounting point on a first lateral side of the clamp and a right third mounting point on a second lateral side of the clamp, wherein the display device is attachable to each of the left third mounting point and the right third mounting point.

4. The corner shot firearm of claim 2 further comprising an ammunition sensor configured to sense a number of ammunition rounds remaining in the secondary firearm, wherein the display device is communicatively coupled to the ammunition sensor, wherein the display device is further configured to display the number of ammunition rounds remaining.

5. The corner shot firearm of claim 1 further comprising a transmission, wherein a first end of the transmission is rotationally coupled to the aim control wheel and a second end of the transmission is rotationally coupled to the first mounting point.

6. The corner shot firearm of claim 5, wherein the transmission comprises a plurality of gears forming a gear train, wherein a first gear of the gear train is rotationally coupled to the aim control wheel, wherein a second gear of the gear train is rotationally coupled to first mounting point.

7. The corner shot firearm of claim 5, wherein the transmission comprises:

a first pulley rotationally coupled to the aim control wheel;

a second pulley rotationally coupled to the first mounting point; and a belt configured to couple the first pulley to second pulley.

8. The corner shot firearm of claim 5, wherein the transmission further comprises:

a power source configured to provide electrical energy;

an electric motor rotationally coupled to the second end of the transmission, wherein the electric motor is electrically coupled to the power source;

a rotation sensor coupled to the aim control wheel, wherein the rotation sensor is configured to generate rotation data corresponding to rotation of the aim control wheel; and a controller electrically coupled to the electric motor, wherein the controller is configured to control the electric motor based on the rotation data.

9. The corner shot firearm of claim 1, wherein the clamp further comprises a second mounting point configured to mount a primary firearm.

10. The corner shot firearm of claim 9, wherein the second mounting point is configured to mount at least one of a hand-rail and a barrel of the primary firearm.

11. The corner shot firearm of claim 9, wherein the clamp further comprises a fourth mounting point configured to mount at least one of a scope configured to provide optical magnification, a light source configured to emit light and a primary camera configured to capture an image, wherein a primary optical axis of the primary camera is parallel to a primary line of fire of a primary firearm mounted to the second mounting point.

12. The corner shot firearm of claim 1, wherein the first mounting point comprises a quick release mechanism configured to facilitate mounting and demounting of the secondary firearm to the first mounting point.

13. The corner shot firearm of claim 1, wherein the first mounting point comprises a receptacle, wherein a dimension of the receptacle corresponds to a dimension of a barrel of the secondary firearm.

14. The corner shot firearm of claim 1, wherein the trigger actuator comprises an electromechanical actuator configured to actuate the secondary trigger based on a control signal received from a controller, wherein the controller is electrically coupled to the accessory trigger, wherein the controller is configured to generate the control signal based on actuation of the accessory trigger, wherein the corner shot firearm further comprises a power source configured to provide electrical energy to the electromechanical actuator.

15. The corner shot firearm of claim 1, wherein the secondary firearm comprises a pistol.

16. The corner shot firearm of claim 15, wherein the first mounting point comprises a receptacle configured to receive at least a portion of a hand-grip of the pistol, wherein a depth of the receptacle is based on a length of the hand-grip.

17. The corner shot firearm of claim 1, wherein a structure of the first mounting point is such as to provide a space around a top of the secondary firearm mounted to the first mounting point in order to facilitate ejection of shell casings from the secondary firearm.

18. The corner shot firearm of claim 1 further comprising a locking mechanism coupled to the first mounting point, wherein the locking mechanism is configured to be set in one of a locked state and an unlocked state, wherein the locking mechanism, while in the locked state, is configured to prevent movement of the first mounting point independent of the rotation of the aim control wheel.

19. The corner shot firearm of claim 18, wherein the locking mechanism, while in the unlocked state, is configured to allow pivotal rotation of the first mounting point by a rotatory force imparted directly to the first mounting point.

20. The corner shot firearm of claim 1 further comprising a secondary firearm brace, wherein a first end of the secondary firearm brace is connected to the first mounting point and a second end of the secondary firearm brace is connectable to a hand-grip of the secondary firearm, wherein the secondary firearm brace is configured to secure the secondary firearm to the first mounting point in spite of a recoil of the secondary firearm upon firing of the secondary firearm.

* * * * *